US009049976B2

(12) United States Patent
Blocker

(10) Patent No.: US 9,049,976 B2
(45) Date of Patent: Jun. 9, 2015

(54) ROTARY SPONGE HAVING AN ADJUSTABLE ELONGATED HANDLE

(71) Applicant: Robin O Blocker, Brentwood, NY (US)

(72) Inventor: Robin O Blocker, Brentwood, NY (US)

( * ) Notice: Subject to any disclaimer, the term of this patent is extended or adjusted under 35 U.S.C. 154(b) by 0 days.

(21) Appl. No.: 13/918,850

(22) Filed: Jun. 14, 2013

(65) Prior Publication Data

US 2014/0366291 A1 Dec. 18, 2014

(51) Int. Cl.
*A47L 11/282* (2006.01)
*A47L 13/16* (2006.01)
*A47L 13/10* (2006.01)

(52) U.S. Cl.
CPC ..... *A47L 11/282* (2013.01); *A47L 13/16* (2013.01); *A47L 13/10* (2013.01)

(58) Field of Classification Search
CPC ..... A47L 11/282
USPC ..... 15/97.1, 144.4
See application file for complete search history.

(56) References Cited

U.S. PATENT DOCUMENTS

| | | | | | |
|---|---|---|---|---|---|
| 2,732,574 | A | * | 1/1956 | Gesell | 15/115 |
| 3,387,312 | A | * | 6/1968 | Westphal | 15/97.1 |
| 4,202,068 | A | * | 5/1980 | Lester et al. | 15/28 |
| 4,335,481 | A | * | 6/1982 | Slayman | 15/29 |
| 4,886,388 | A | | 12/1989 | Gulker et al. | |
| 4,893,370 | A | | 1/1990 | Klotz | |
| 5,201,149 | A | * | 4/1993 | Eisenblatter | 451/526 |
| 5,311,634 | A | | 5/1994 | Andros | |
| 5,353,461 | A | * | 10/1994 | Enriquez | 15/23 |
| 5,500,972 | A | | 3/1996 | Foster | |
| 5,511,269 | A | * | 4/1996 | Watson | 15/22.1 |
| 6,338,170 | B1 | | 1/2002 | De Simone | |
| 6,401,289 | B1 | * | 6/2002 | Herbert | 15/97.1 |
| 7,331,077 | B1 | * | 2/2008 | Henry | 15/23 |
| 8,381,344 | B1 | * | 2/2013 | Bergman et al. | 15/1.7 |
| 2003/0213078 | A1 | * | 11/2003 | Kristofek | 15/97.1 |
| 2004/0083567 | A1 | * | 5/2004 | Lies | 15/28 |
| 2004/0123410 | A1 | | 7/2004 | Terry et al. | |
| 2005/0050666 | A1 | | 3/2005 | Schumm | |
| 2005/0066458 | A1 | * | 3/2005 | Belcastro | 15/28 |
| 2006/0248666 | A1 | * | 11/2006 | Lies | 15/23 |
| 2008/0047085 | A1 | | 2/2008 | Kolarevic et al. | |
| 2012/0165710 | A1 | | 6/2012 | Nichols | |

* cited by examiner

*Primary Examiner* — Randall Chin
(74) *Attorney, Agent, or Firm* — The Keys Law Firm, PLLC

(57) ABSTRACT

An automatically rotating sponge apparatus for facilitating reaching and cleaning in hard to reach places comprising an extendable rod having disposed at one end a rotating attaching member, a motor, and a switch for actuating the motor, wherein attaching member is configured to attach and hold a conventional sponge and the attaching member is connected to the motor such that it rotates about its center axis by the motor when the motor is actuated. In this manner, the rotating sponge apparatus allows a conventional sponge being held by the attaching member to be extended beyond arms reach the length of the extendable rod and automatically rotated to generate cleaning action friction.

10 Claims, 2 Drawing Sheets

ROTARY SPONGE HAVING AN ADJUSTABLE ELONGATED HANDLE

BACKGROUND OF THE INVENTION

1. Field of the Invention

This invention relates generally to cleaning components and, more particularly, to an apparatus having a sponge configured to selectively rotate and attached to an adjustable, elongated handle.

2. Description of the Prior Art

For some time, sponges have been a ubiquitous cleaning aid. Sponges are commonly used for cleaning in bathrooms and kitchens of homes and businesses. Sponges are also used for cleaning vehicles and other structures. Because of its ability to absorb water and water based solutions, a sponge are particularly useful for cleaning all types of impervious surfaces.

One problem which exists with the use of conventional sponges is that a user of a sponge typically can only use the sponge to clean surfaces within arm's reach of the user. Moreover, as cleaning with a sponge typically requires the user to manually move the sponge in a reciprocating or rotary fashion in create the friction necessary to optimize the sponge's cleaning action, it can often cause considerable stress to the hands, arms and joints of a user. This is particularly the can wherein a user cleans with a sponge at frequent intervals and/or for a substantial time.

Consequently, there remains a need for an apparatus which can extend the cleaning range of a sponge beyond that of the arm's reach of the user. It would be helpful for such an apparatus to be configured to adjust its length as desired by the user. It would be additionally desirable for such an apparatus have the ability automatically create the friction necessary to optimize the sponge's cleaning action without requiring additional manual exertion by the user.

The Applicant's invention described herein provides for an automatically rotating sponge apparatus for assisting in the cleaning of hard to reach areas. The primary components of Applicant's rotating sponge apparatus are an extendable rod having disposed at one end a rotating attaching member with a conventional sponge attached thereto, a motor, and a switch for actuating the motor. When in operation, the rotating sponge apparatus allows a user to hold the extendable rod so that the sponge contacts a surface to be cleaned and actuate the motor, causing the attaching member to rotate the sponge to automatically create sponge cleaning action friction between the sponge and the surface to be cleaned. As a result, many of the limitations imposed by standard conventional sponges are removed.

SUMMARY OF THE INVENTION

An automatically rotating sponge apparatus for facilitating reaching and cleaning in hard to reach places. The rotating sponge apparatus comprises an extendable rod having disposed at one end a rotating attaching member, a motor, and a switch for actuating the motor, wherein attaching member is configured to attach and hold a conventional sponge and the attaching member is connected to the motor such that it rotates about its center axis by the motor when the motor is actuated. In this manner, the rotating sponge apparatus allows a conventional sponge being held by the attaching member to be extended the length of the extendable rod beyond arms reach and automatically rotated to generate cleaning action friction.

The rotating sponge apparatus is operated by first attaching a sponge to the attaching member, typically embodied as a pin and a stopper adapted to slidably engage the pin. The pin is configured to extend vertically from the extendable rod in a parallel direction in its default position and receive the sponge as an engaging means for attaching the sponge. In this way, a sponge is pierced centrally by the pin and slid over the pin, with the stopper then being slid over the pin as a retaining means for keeping the sponge on the pin. Once the sponge is in place, the extendable rod is held by the user, who then directs the sponge at the end of the rod toward the surface desired to be cleaned. In this manner, the extendable rod provides a means for extending the reach of a sponge. The user then engages the switch to actuate the motor and, as it provides a means for rotating the pin, this results in the sponge spinning to create cleaning action friction. The switch can then be selectively disengaged to stop the spinning as desired by the user.

It is an object of this invention to provide an apparatus which can extend the cleaning range of a sponge beyond that of the arm's reach of the user.

It is another object of this invention to provide an apparatus configured to adjust its length as desired by the user.

It is yet another object of this invention to provide an apparatus having the ability create the friction necessary to optimize the sponge's cleaning action without requiring additional manual exertion by the user.

These and other objects will be apparent to one of skill in the art.

DETAILED DESCRIPTION OF THE INVENTION

Figure 1:
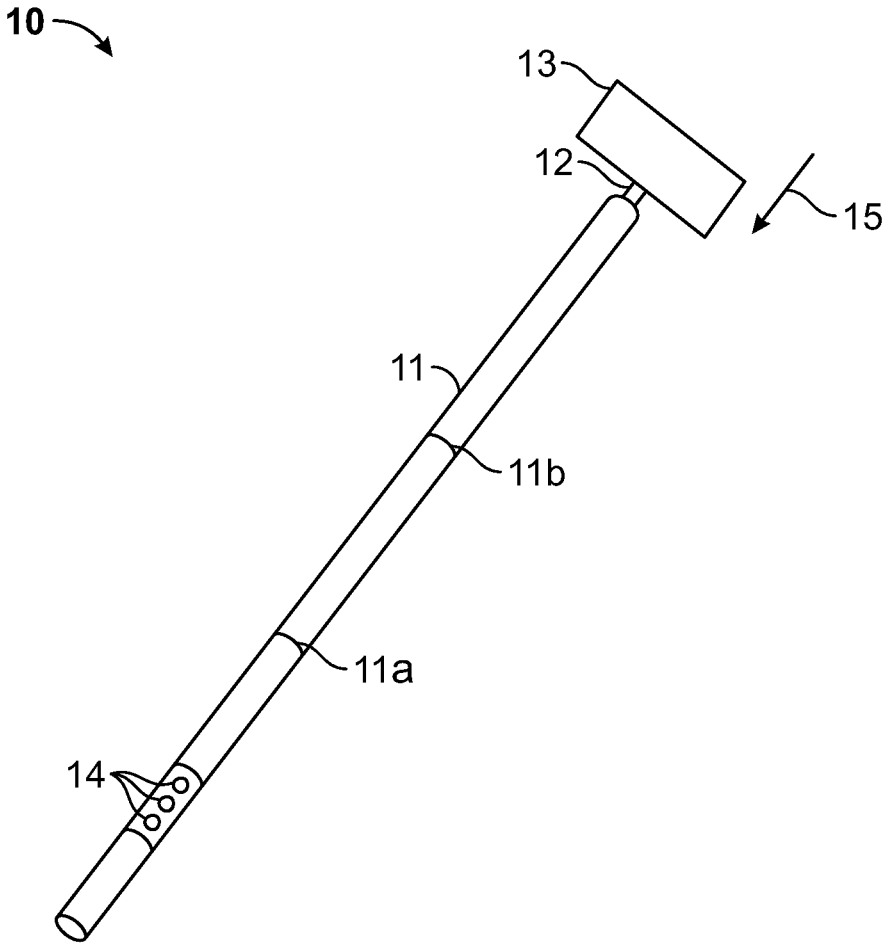
FIG. 1 is a front elevational view of a rotating sponge apparatus built in accordance with the present invention.

Referring now to the drawings and in particular FIG. 1, a rotating sponge apparatus 10 built in accordance with the preferred embodiment of the present invention is shown comprising an elongated telescoping rod 11 having a proximal end and a distal end, a rotating attaching member 12 adapted to attach to and retain a conventional sponge 13 at the distal end of the telescoping rod 11, and a plurality of switches 14 near the proximal end of the telescoping rod 11. The telescoping rod 11 is shown fully extended; however, the its length is adjustable by sliding a first ridge 11*a* towards a second ridge 11*b* to cause the section of the rod disposed between to recede telescopically into the body of the rod 11. In one embodiment, the rod extends 12 inches when retracted and 18 inches when extended.

The attaching member 12 is defined by a pin and stopper structure, wherein the pin is permanently attached to the rod 11 and the stopper is adapted to removably engage the pin in a manner which would secure any structure which inserted over the pin before the stopper. Thus, a sponge 13 is attached to the rotating sponge apparatus 10 by removing the stopper from the pin, inserting the sponge 13 over the pin by piercing the sponge body with the pin and sliding the sponge 13 in an engaging direction 15 over the pin, and the sliding the stopper over the pin in an engaging direction 15. It is contemplated that the stopper be constructed to sufficiently hold a sponge 13 securely in place while the attaching member is spinning, while also being of a material and sized to not scratch or otherwise damage a surface being cleaned due to its location relative to the body of the sponge 13.

On the interior of the rod 11 is a motor, connected to the switches 14 and the attaching member 12, and configured to rotate the attaching member 12 about its own center axis so that an attached sponge 13 would spin whenever the switches 14 are engaged to actuate the motor. The motor is additionally connected to a power source, also disposed on the interior of the rod 11, embodied as conventional batteries in a battery compartment. The power source provides a power supply means for selectively providing power to the motor. It is contemplated that in the preferred embodiment, there are three switches 14 disposed on the rod 11, wherein a first switch is engaged to actuate the motor at a first speed, a second switch is engaged to actuate the motor at a second speed, and a third switch is engaged to turn the motor off. As such, the first switch and the second switch each provide a switching means for selectively providing power to the motor, while the third switch provide a switching means for selectively ceasing the provision of power to the motor.

Figure 2:
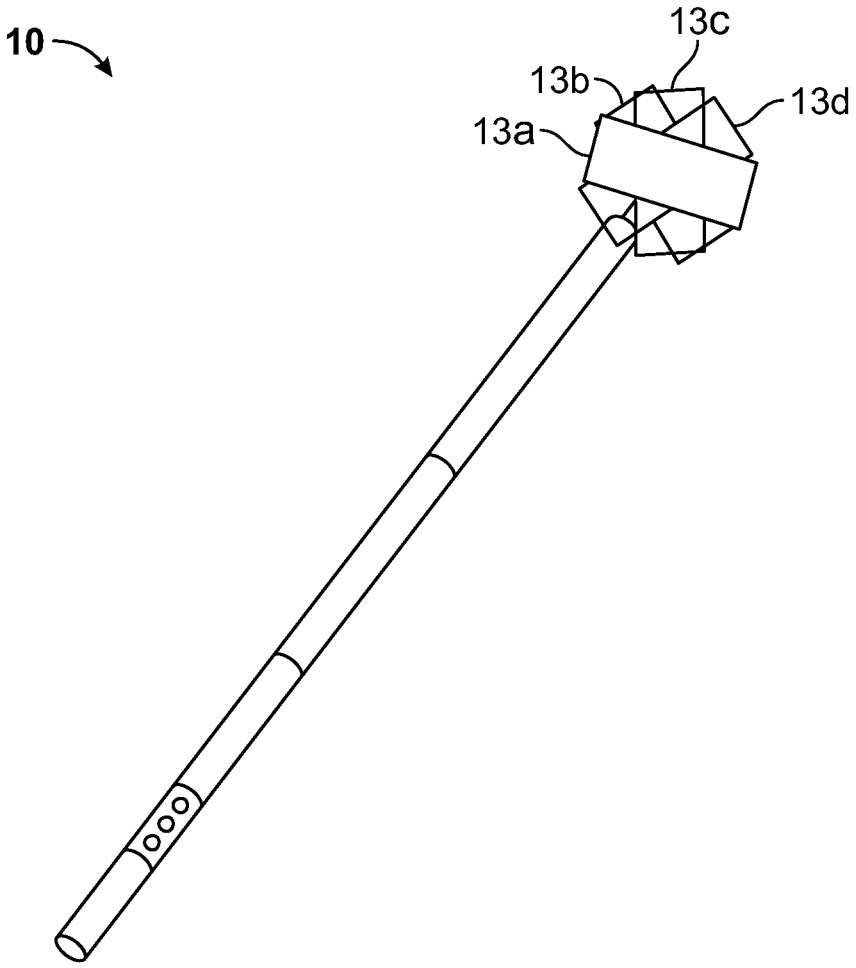
FIG. 2 is a front elevational view of a rotating sponge apparatus built in accordance with the present invention wherein the different configurations of the sponge are shown.

Referring now to FIGS. 1 and 2, the sponge 13 of rotating sponge apparatus 10 can be selectively placed in a plurality of angular configurations. Shown in FIG. 2 is a sponge in a first configuration 13*a*, a sponge in a second configuration 13*b*, a sponge in a third configuration 13*c*, and a sponge in a fourth configuration 13*d*. whereby in each position, the sponge 13 is angularly fixed in a locked angular position in which it is rotated. An attached sponge 13 can be selectively placed in any of these positions by the user because the angle of the pin of the attaching member 12 can be adjusted as desired to assist in cleaning hard to reach areas. In one embodiment, the sponge can be adjusted at 45, 90 and 180 degree angles.

In addition, it is understood that a sponge can be attached in the attaching member in one of a plurality of configurations. A sponge can be attached with its broad side perpendicular to the pin, with either the abrasive side or the non-abrasive side of a sponge facing away from the rod 11, or with its broad side parallel to the pin.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for holding and rotating a conventional sponge, comprising:

an attaching member adapted to attach and hold a conventional sponge, wherein the attaching member includes a pin and a stopper and is operative to hold a conventional sponge by removing the stopper from the pin, inserting the sponge over the pin by piercing the sponge body with the pin and sliding the sponge in an engaging direction over the pin, and then sliding the stopper over the pin;

a rod base defined by an elongated substantially hollow tube having a proximal end and a distal end, wherein the distal end of the base is attached to the pin of the attaching member;

a motor disposed within the base mechanically connected to said pin;

a power source within the base electrically connected to said motor, wherein the motor is operated to rotate the pin about the center axis of the pin when electrical power from the power source is supplied to the motor; and said attaching member adapted to be angularly fixed in one of a plurality of locked angular positions when the pin is being rotated.

2. The apparatus of claim 1, wherein the length of the rod base is adapted to be selectively increased or decreased at any time.

3. The apparatus of claim 1, wherein the exterior structure of the rod base is defined by at least two discrete tubes arranged telescopically so as to allow the length of the rod base to be selectively increased or decreased.

4. The apparatus of claim 1, additionally comprising at least one manual switch disposed on said rod base and connected to said motor and adapted to allow a user to selectively provide electrical power from the power source to the motor.

5. The apparatus of claim 4, wherein two manual switches are disposed on said rod base.

6. The apparatus of claim 1, additionally comprising a manual switch disposed on said rod base and connected to said motor and adapted to allow a user to selectively cease the provision of electrical power to the motor.

7. A apparatus for holding and rotating a conventional sponge, comprising:

an engaging means for attaching a sponge by piercing the sponge body therewith and compressing it in place;

a means for extending the reach of a sponge having attached at one end of said engaging means;

a retaining means for keeping the sponge on the engaging means;

a means for rotating the engaging means;

a power supply means for selectively providing power to the means for rotating:, and said engaging means adapted to be angularly fixed in one of a plurality of locked angular positions while being rotated.

8. The apparatus of claim 7, additionally comprising at least one switching means for selectively providing power to the means for rotating.

9. The apparatus of claim 7, additionally comprising a plurality of discrete switching means for selectively providing power to the means for rotating.

10. The apparatus of claim 7, additionally comprising a switching means for selectively ceasing the provision of power to the means for rotating.

* * * * *